United States Patent [19]

Hochman

[11] 4,066,169

[45] Jan. 3, 1978

[54] BODIES TO BE ATTACHED TO SINGLE-PRONG HOOKS

[75] Inventor: Arthur Hochman, Union City, N.J.

[73] Assignee: Art Phyl Creations, Newark, N.J.

[21] Appl. No.: 717,304

[22] Filed: Aug. 24, 1976

[51] Int. Cl.[2] ..... A47F 7/00

[52] U.S. Cl. ..... 211/57.1; 248/220.3

[58] Field of Search ..... 211/57.1, 54.1, 59.1, 211/123, 105.1, 106; 248/DIG. 3, 220.3

[56] References Cited

U.S. PATENT DOCUMENTS

| | | | |
|---|---|---|---|
| 2,957,671 | 10/1960 | Messier | 248/DIG. 3 |
| 3,186,560 | 6/1965 | Cristino | 248/DIG. 3 |
| 3,638,801 | 2/1972 | Larson | 248/DIG. 3 |
| 3,912,084 | 10/1975 | Valiulis | 248/DIG. 3 |
| 3,918,668 | 11/1975 | Thorpe | 211/59.1 X |

*Primary Examiner*—Roy D. Frazier
*Assistant Examiner*—Robert W. Gibson, Jr.
*Attorney, Agent, or Firm*—Blum, Moscovitz, Friedman & Kaplan

[57] ABSTRACT

A body which is adapted to be attached to a single-prong support hook so as to render the latter less hazardous as well as to facilitate the supporting of packages for display purposes. The body is made of a substantially rigid material such as a suitable plastic and has a length sufficient to enable the body to rest on the single-prong hook while the latter is connected to and projects forwardly from a carrying structure, the body being sufficiently long to cover almost the entire hook. This body is preferably of a substantially rectangular transverse cross section and is adapted to be received in elongated slots formed at the upper portions of packages which are to be placed on the body and hang therefrom for display purposes. At its rear region which is situated next to the carrying structure the body has a configuration for releasably fastening the body with the hook so that the body will remain stably in a condition preventing any possible injury from the hook while at the same time adapting the single prong hook to a construction according to which it is possible to support packages which have at their upper ends elongated slots to receive the body.

10 Claims, 12 Drawing Figures

20
22
24
26
30
32
34
36
38
40
42
44
46
48
50
52
54
3
4
5

BODIES TO BE ATTACHED TO SINGLE-PRONG HOOKS

BACKGROUND OF THE INVENTION

The present invention relates to display devices of the type where prong-like hooks project from a pegboard or other carrying structure for the purpose of supporting in retail outlets packages which are readily visible to prospective purchasers.

Display devices of the above type are widely used in all types of retail establishments. It has become customary to use in devices of the type over the years single-prong hooks. These hooks are in the form of a fairly robust elongated substantially rigid rod or wire member having at its rear end a configuration enabling it to project into the opening of a carrying structure so that the single-prong hook can in a stable manner project forwardly to be received in openings of the packages which are to be suspended one behind the other from the hook.

Arrangements of the above general type for the purpose of placing on display packaged merchandise in virtually universal in retail outlets. With space at a premium, most displays of the above type are set up with little or no regard for the safety of the consumer or for the personnel of the retail establishment. Because the single-prong hooks are in the form of relatively rigid wires as set forth above, they terminate at their front free ends in hazardous objects which unavoidably cause a large number of injuries sustained both by consumers as well as store employees who are responsible for restocking the hooks. Injuries of the above type have proved to be fairly frequent and, unfortunately, in many cases such injuries involve the eyes, causing partial or permanent loss of sight. In addition, a great many of the above injuries involve children and are highly severe in nature.

In order to alleviate the above conditions, it has been proposed to provide display hooks which are of a broader construction than the above single-prong hooks so that there is less possibility of injuries due to puncture or abrasion by the free ends of the single-prong hooks. As a result of these considerations, most manufacturers of carded products have converted to a construction where the carded products have at their upper end regions slotted die-cut holes forming horizontally extending elongated slots to receive the broader types of supporting hooks for displays of the above type. These slotted openings are of course superior to the single-hole perforations designed to receive the single-prong wire-type of supports.

With slots of the above type formed in the carded products, it is possible to use double-loop or hairpin-type of prongs, and these supports are much safer than the single-prong type of supports inasmuch as the double-loop or hairpin-type prongs have rounded front ends which cannot cause the injury occasioned by inadvertent engagement with the free ends of the single-prong hooks. Regrettably, however, conversion from the single-prong hooks to the double-loop or hairpin-type of prongs will take several years before becoming standard practice in retail outlets. The result is that single-prong hooks continue to be utilized to a very large extent. There are in fact millions, and probably billions, of single-prong hooks in use in retail establishments. The cost of replacing these single-prong hooks with loop-type hooks is staggering, and it can only be expected that the conversion to the safer type of hook will take an extremely long time.

SUMMARY OF THE INVENTION

It is accordingly a primary object of the present invention to provide a structure which will enable single-prong hooks to continue to be utilized while being converted to a much safer type of construction closely simulating that which is afforded by the loop or hairpin type of hook.

Thus, it is an object of the present invention to provide a relatively inexpensive body, capable of being purchased in large numbers and at low cost, and capable of being easily mounted on the single-prong types of hooks to enable the latter to be rendered far less dangerous while at the same time enabling them also to accommodate the carded packages which have the slots at their upper ends.

The objects of the present invention thus include the provision of a body capable of forming a hook-guard while at the same time adapted to receive the different types of carded packages.

In addition, it is an object of the present invention to provide a construction which is less expensive and safer than all wire hooks which are currently in use.

Moreover, it is an object of the present invention not only to provide a safer structure but also a structure capable of utilizing bright colors for greater visibility.

Furthermore, it is an object of the present invention to provide a construction capable of combining the strength of steel with the flexibility of plastic.

Also it is an object of the present invention to provide a construction which will stablize the packages for neater displays while at the same time rendering safety procedures more economical to carry out.

Also it is an object of the present invention to provide a construction according to which it is possible easily to provide a color-coding for inventory control as well as a convenient arrangement to indicate when re-ordering of articles is required.

In addition it is an object of the present invention to provide a construction which makes it possible very rapidly to set up packages for display.

The objects of the present invention also include a construction according to which it becomes possible to install the structure of the invention without requiring the use of any tools in an extremely and convenient manner.

According to the invention the structure includes an elongated substantially rigid body, which may be made of plastic, for example, and which is adapted to rest directly on a single-prong hook so as to be supported thereby while covering the hook so as to prevent the latter from being exposed and causing injury. The elongated boy of the invention has a length sufficiently great to cover almost the entire single-prong hook while the latter is carried by and projects forwardly from a carrying structure, with the body resting directly on the single-prong hook and having at its rear portion a means for releasably fastening the body to the hook so that the body will reliably be maintained on the single-prong hook. This body which forms the structure of the invention is preferably of a substantially rectangular transverse cross section and of a size which adapts it to be received in the horizontally extending slots formed at the upper regions of carded packages, so that a number of such packages may be slipped onto the body of the invention to be supported thereby while the body itself is supported by the single-prong hook in a manner which prevents any injury therefrom.

BRIEF DESCRIPTION OF DRAWINGS

The invention is illustrated by way of example in the accompanying drawings which form part of this application and in which.

DESCRIPTION OF PREFERRED EMBODIMENTS

Figures 1, 2, 3, 4, 5:
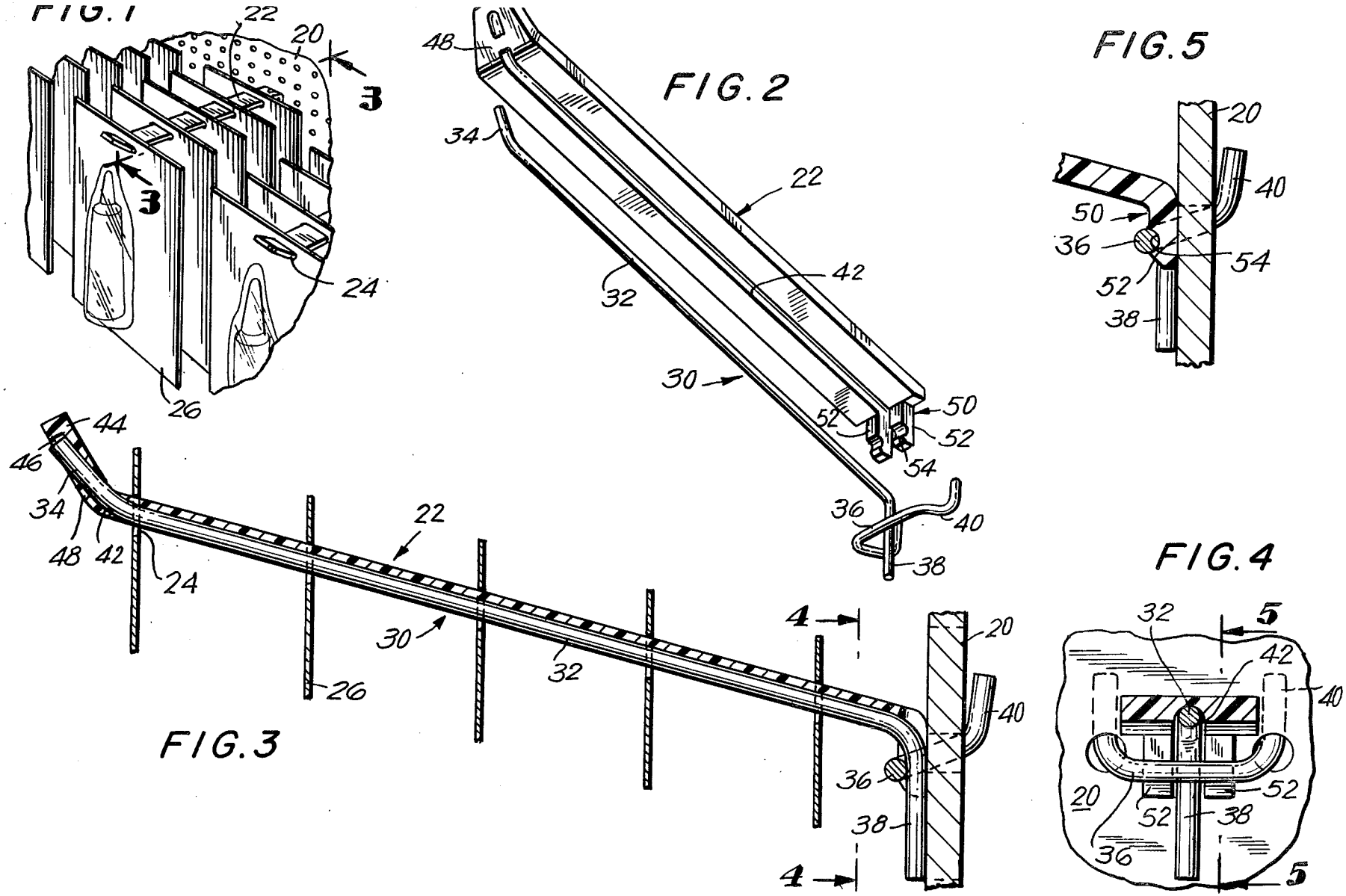
FIG. 1 is a fragmentary perspective view showing how the structure of the invention is utilized for display purposes.
FIG. 2 is an exploded perspective view of one type of single-prong hook and the body of the invention.
FIG. 3 illustrates how the parts shown in FIG. 2 are assembled and carried by a pegboard, with packages being shown supported by the structure of the invention in a sectional fragmentary manner taken on line 3—3 of FIG. 1.
FIG. 4 is a transverse fragmentary sectional elevation of the structure of FIG. 3 taken along line 4—4 of FIG. 3 in the direction of the arrows.
FIG. 5 is a fragmentary sectional elevation of the structure of FIG. 4 taken alone line 5—5 of FIG. 4 in the direction of the arrows.

Referring first to FIG. 1, there is fragmentarily illustrated therein a carrying structure in the form of a pegboard 20 which supports, for display purposes, in a manner described in greater detail below, a plurality of bodies 22 which are constructed in accordance with the present invention. These bodies 22 are of a substantially rectangular transverse cross section and are adapted to be received in the elongated horizontal slots 24 which are formed adjacent the upper horizontal edges of carded packages 26, such as those indicated in FIG. 1. Thus, a number of these carded packages can be slipped onto the bodies 22 to be supported thereby for display purposes as illustrated in FIG. 1. As the packages 26 are sold, they are removed from the bodies 22, and when any body 22 is completely free of packages, or when only a small number of packages remain thereon, additional packages are supported thereon to replace those which have been removed.

One of these bodies 22 is shown in FIG. 2 in a perspective view as it appears when looking toward the lower surface of the body 22. This body 22 is shown in FIG. 2 above a single-prong pegboard hook 30 which is attached to the pegboard 20 in the manner shown in FIGS. 3–5 and described below.

The conventional single-prong pegboard hook 30 includes an elongated substantially rigid wire or rod 32 which is of circular cross section and which is substantially rigid. The elongated wire 32 terminates in a front free end 34 which is upwardly inclined with respect to the remainder of the rod 32 and which when exposed can cause injury as pointed out above. This rod or wire 32 may be made, for example, of stainless steel.

The wire or rod 32 is fixed, as by welding, for example, to a transverse wire or rod member 36 of the same material as the wire 32. The transverse member 36 extends transversely across a downwardly extending rear portion 38 of the wire 32. This member 36 has at its outer ends rearwardly extending substantially L-shaped portions 40 adapted to be received in openings of the pegboard 20.

Thus, in order to fasten the hook 30 to the pegboard 20, the substantially L-shaped portions 40 of the member 36 are passed through a pair of openings of the pegboard 20 in the manner clearly apparent from FIGS. 3–5 so as to cause the rear downwardly extending portion 38 of the wire 32 to extend along and engage the front surface of the pegboard 20, and the hook 30 will thus be supported in a stable manner as is clearly apparent from FIGS. 3–5.

In order to be able to convert these hooks 30 into a safer structure which at the same time is capable of supporting packages 26 which have the horizontal slots 24, the body 22 of the present invention is provided. This body 22 is of elongated configuration and is substantially rigid, being preferably made of a suitable plastic material. Any one of a large number of plastics are suitable, such as, for example, polyvinyl chloride, polystyrene, etc. The elongated body 22 is of a length sufficiently great to enable it to extend entirely along the wire 32 which projects forwardly from the pegboard 20 in the manner shown in FIG. 3. This body 22 is adapted to rest at its lower surface on the wire 32. In the illustrated example the body 22 is formed at its lower surface with an elongated groove 42 which receives the wire 32 in the manner which is clearly apparent from FIGS. 3 and 4.

It will be seen that the body 22 of the present invention has a front upwardly tilted free end portion 44 extending along the upwardly tilted front end portion 34 of the wire 32. At the portion 44 the body 22 is formed with a closed end 46 for the groove 42, this closed end 46 being situated just in front of the front end of the portion 34.

Just to the rear of the front closed end 46 of the groove 42, the body 22 has a transverse bridging portion 48 which extends across the groove 42 and is formed integrally with the remainder of the body 22. This bridging portion 48 defines with the remainder of the groove 42 at the location of the bridging portion 48 an opening through which the front portion 34 of the rod 32 extends so that in this way a secure connection is provided with the rod or wire 32 at the front end region thereof.

At its rear end region the body 22 has a downwardly extending part 50 in the form of a pair of legs 52 integral with the remainder of the body 22. It will be noted that these legs 52 extend along and directly engage the front surface of the pegboard 20.

These legs 52 form part of a fastening means for fastening the body 22 to the hook 30 inasmuch as the legs 52 are respectively formed with transverse grooves 54 capable of receiving a part of the transverse portion 36 of the hook 30. The cooperation between each leg 52 and the transverse portion 36 of the hook 30 is most clearly apparent from FIG. 5. Moreover, FIGS. 3 and 4 clearly illustrate how the downwardly extending rear portion 38 of the wire 32 is received between these legs 52.

As is apparent from the above, it is a simple matter to fasten a body 22 quickly to a hook 30. It is only required to place the wire 32 within the groove 42 while slipping the front end 34 behind the bridging portion 48, and the legs 52 are simply snapped onto the transverse portion 36, the plastic which is used for the body 22 being sufficiently flexible for this purpose. In this way the body 22 is supported in a stable manner on the hook 30 and the latter can be fastened to the pegboard 20 while carrying the body 22. It will be noted that the body 22 cannot tilt laterally with respect to the hook 30 and forms an exceedingly stable supporting structure while at the same time preventing any injury from the hook 30. With the body 22 thus mounted on the hook 30, it is a simple matter to extend the body through the slots 24 of the packages 26, and it will be seen that the extent to which the wire 32 projects downwardly from the body 22 beyond the groove 42 thereof does not in any way interfere with the mounting of packages 26 on and removal thereof from the body 22 when supported by the hook 30.

It is apparent that the bodies 22 can be manufactured as by injection molding, for example, in large numbers at an extremely low cost, so that these bodies can readily be purchased by retailers. The bodies are readily snapped without any tools onto the hooks 30 to render the latter safe as well as to provide a convenient structure for carrying packages such as the packages 26 referred to above.

Figure 6:
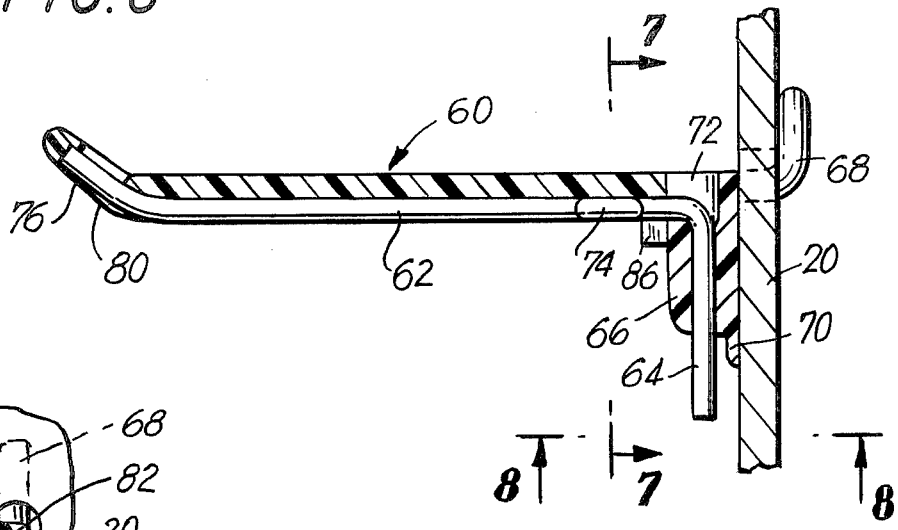
FIG. 6 is a longitudinal sectional elevation of another embodiment of a body according to the invention shown carried by another type of single-prong hook which is carried by and projects from a different carrying structure.
Figure 7:
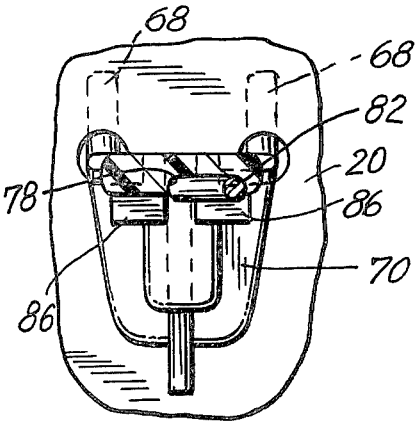
FIG. 7 is a transverse section of the structure of FIG. 6 taken along line 7—7 of FIG. 6 in the direction of the arrows.
Figure 8:
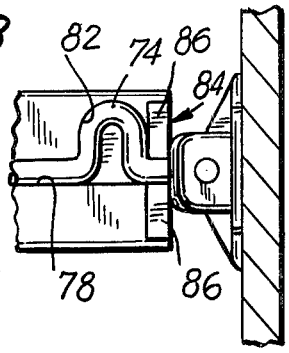
FIG. 8 is a fragmentary bottom plan view of the structure of FIG. 6 taken along line 8—8 of FIG. 6 in the direction of the arrows.

Referring now to FIGS. 6–8, there is illustrated therein another form of a body 60 according to the present invention adapted to extend along and be supported by a single-prong hook 62 which is of a well known type different from the hook 30 shown in FIG. 2. Thus, the single-prong hook 62 has at its rear a downwardly extending portion 64 adapted to extend through a vertical opening formed in a carrying structure which includes the plastic member 66. This member has a rear portion engaging the front surface of a pegboard 20 which may be identical with the pegboard 20 referred to above. The plastic member 66 of the carrying structure has integral therewith a pair of L-shaped portions 68 adapted to pass through a pair of openings of the pegboard 20, as is apparent from FIGS. 6 and 7. The rear portion 70 of the member 66 of the carrying structure is integrally formed with a forwardly extending portion which is formed with the vertical bore which receives the downwardly extending rear part 64 of the rod or wire 62. At its upper part the member 66 is formed with an opening 72 which is open at its front end so that the part of the rod or wire 62 just in front of the downwardly extending part 64 thereof can extend freely from the opening 72 forwardly beyond the member 66 in the manner apparent from FIG. 6.

The single-prong hook 62 is of the type which has forwardly of its rear, downwardly extending part 64 a loop portion 74, and of course at its front end the hook 62 is tilted upwardly as shown at its front end region 76.

The plastic body 66 of the embodiment of FIGS. 6–8 is formed at its lower surface with an elongated groove 78 which receives the elongated hook member 62 in much the same way that the groove 42 of the embodiment of FIGS. 1–5 receives the part 32 of the hook 30. Also, at its front end the body 60 is tilted upwardly in conformity with the upwardly tilted portion 76 of the hook 62, and at this forward portion the body 60 carries a bridging portion 80 which extends across the groove 78 in much the same way that the bridging portion 48 extends across the groove 42.

In order to accommodate the loop part 74 of the hook 62, the groove 78 is formed with a lateral extension or pocket 82 shown most clearly in FIGS. 7 and 8, and the loop 74 is received in this pocket 78 when the elongated portion of the hook 62 is received in the groove 78.

Moreover, the body 60 has at its rear a downwardly extending part 84 integral with the remainder of the body 60 and including a pair of legs 86 between which the part of the hook 62 situated to the rear of the loop 74 extends. The rear surface of the downwardly extending part 84 of the body 60 is flush against the front surface of the member 66 of the carrying structure. The downwardly extending part 84 is formed at its right leg 86, as viewed in FIG. 7, with a forwardly extending groove which receives the rear portion of the loop 74 when the latter is introduced into the pocket 82, so that in this way the downwardly extending part 84 forms part of a fastening means for fastening the body 60 to the hook 62. In addition, the pocket 82 is shaped so as to snap over the loop 82, and thus in this way the body 60 is reliably fastened to the hook 62.

Thus, with the embodiment of FIGS. 6–8, the body 60 also will prevent any injury from the hook 62 while at the same time being stably carried thereby in the manner apparent from FIG. 6. This body 60 has the same general transverse dimensions as the body 22 and can be received in the same way in the slots 24 formed at the upper portions of the carded packages 26. Thus the embodiment of FIGS. 6–8 will achieve all of the advantages of the invention for the type of hook 62 which is shown in FIGS. 6–8.

Referring now to FIGS. 9–12, in the embodiment of the invention which is illustrated therein is a third type of hook 90 adapted to be carried by a suitable carrying structure as described below. This hook 90 is in the form of a substantially rigid wire or rod which at its front unillustrated end portion is identical with the hook or rod 62 and the hook or rod 30. This hook 90 extends straight back to its rear downwardly extending portion 92 shown most clearly in FIG. 11. Forwardly of its downwardly extending portion 92 the hook 90 has a transverse portion 94 welded to the upper straight portion of the hook 90 at the lower surface of the latter, as shown most clearly in FIGS. 9–12.

In this embodiment the carrying structure 96 takes the form of an elongated plastic body formed with transverse grooves 98 as well as with vertically extending openings 100 for selectively receiving the downwardly extending portions 92 of the hooks 90.

With this embodiment also there is a plastic body 102 according to the present invention, made of the same material as the bodies 22 and 60 described above. This body 102 is also formed at its lower surface with an elongated groove 104 which receives the upper elongated portion of the hook 90 in the manner shown in FIGS. 9–12 and in much the same way that the hook portion 32 is received in the groove 42 as described above. At its front end the body 102 has a construction identical with the front end portions of the bodies 22 and 60, so that this part of the structure is not shown in the drawings. Thus the hook 90 has an upwardly tilted front end portion and the body 102 has at its front end region also an upwardly tilted front end portion formed with a continuation of the groove 104 and having a bridging portion identical with the bridging portions 48 and 80 described above and cooperating in the same way with the hook 90.

At its rear portion the body 102 has a downwardly extending part 106 which has a rear surface 108 engaging the front surface 97 of the carrying structure 96 so that the body 102 is stably supported on the hook 90 and in engagement with the carrying structure 96 in the manner apparent from FIGS. 9–12.

The downwardly extending portion 106 is in the form of a pair of legs 110 between which the rear portion of the hook 90 extends just in front of the downwardly extending part 92 thereof. The part of the hook 90 which extends between the legs 110 is situated just to the rear of the transverse portion 94 which engages the forwardly directed surfaces of the downwardly extending legs 110. These legs 110 are formed with forwardly directed grooves which snap over the rear part of the transverse portion 94 so that the downwardly extending part 108 also forms in this way a fastening means for fastening the body 102 to the hook 90.

Thus it is apparent that with the embodiment of FIGS. 9–12 the plastic body 102 also is stably carried by the hook 90 while preventing any injury from the latter and while adapting the structure to carry articles such as the carded packages 26 in the manner described above according to which the elongated body 102 will be received in and extend through the slots 24 at the upper ends of the carded packages 26.

Figure 9:
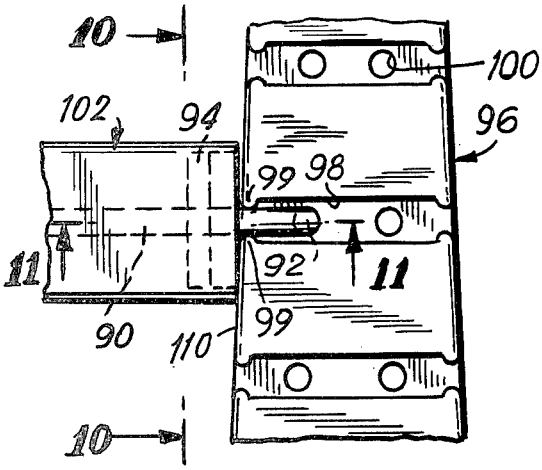
FIG. 9 is a fragmentary top plan view of a further embodiment of a body according to the present invention shown carried by still another type of single-prong hook which is illustrated in FIG. 9 carried by a third type of carrying structure.
Figure 11:
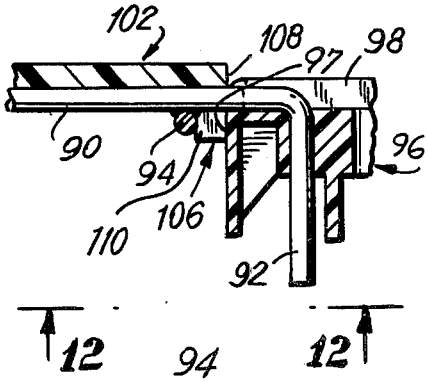
FIG. 11 is a sectional view of the structure of FIG. 9 taken along line 11—11 of FIG. 9 in the direction of the arrows.
Figure 10:
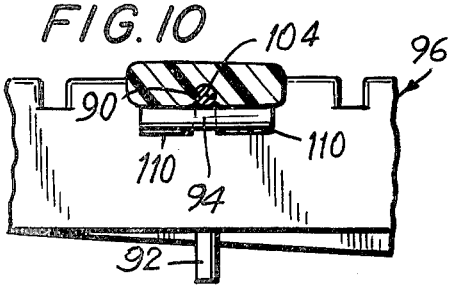
FIG. 10 is a transverse section of the structure of FIG. 9 taken along line 10—10 of FIG. 9 in the direction of the arrows.
Figure 12:
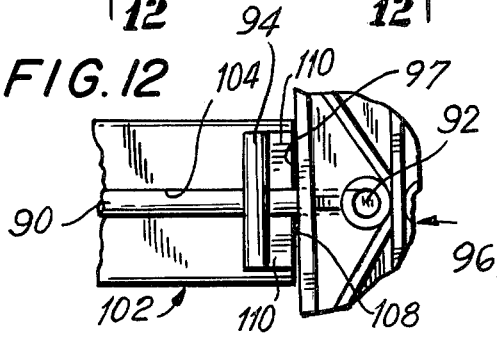
FIG. 12 is a bottom plan view taken along line 12—12 of FIG. 11 in the direction of the arrows.

As shown in FIG. 9, carrying structure 96 has at the ends of grooves 98 ribs 99 capable of engaging rod 90 to increase the stability of rod 90.

It is apparent, therefore, that with all of the embodiments of the invention, it is possible to manufacture relatively inexpensive plastic bodies which can easily be joined without tools quickly and effectively to single-prong types of hooks, the structure of the invention enabling the front tip of the single-prong hook to be rendered harmless while also adapting the hook to form a support for the body which can be conveniently be received in horizontal slots of carded packages as described above.

The solid bodies of the invention may easily be color-coded for inventory control. Also, reorder points can easily be indicated along the solid body. In addition the bodies can be color-coded to match packages for faster set-ups, and color-coding can be provided for aesthetic reasons to match package colors.

What is claimed is:

1. For use with a single-prong support hook having a front end, an elongated substantially rigid body adapted to rest at a lower surface thereof, which extends longitudinally along said body, on a single-prong support hook which is adapted to be connected at its rear end to and project forwardly from a carrying structure, with said body having a length sufficiently great to extend along the hook, in engagement therewith at said lower surface of said body and without clearance between said hook and body, forwardly from the carrying structure at least slightly beyond the front end of the hook, said body being of substantially rectangular transverse cross section and projecting laterally through a substantial distance on opposite sides of the single-prong hook while resting thereon, and said body having a fastening means for releasably fastening the body to a single-prong hook, carried by and projecting forwardly from a carrying structure, and for maintaining said body assembled with a single-prong hook while being supported thereby in a manner enabling the body together with the hook engaged thereby to be received in slots formed in packages which are to be displayed.

2. The structure of claim 1 and wherein said body is made of a plastic material.

3. The structure of claim 1 and wherein said body is formed at its lower surface which is adapted to engage the hook with an elongated groove which receives the hook.

4. A structure as recited in claim 1 and wherein said body has at a rear portion thereof a downwardly extending part adapted to engage the front surface of a carrying structure.

5. For use with a single-prong support hook having a front end, an elongated substantially rigid body adapted to rest at a lower surface thereof on a single-prong support hook which is adapted to be connected at its rear end to and project forwardly from a carrying structure, with said body having a length sufficiently great to extend along the hook forwardly from the carrying structure at least slightly beyond the front end of the hook, said body being of substantially rectangular transverse cross section and projecting laterally through a substantial distance on opposite sides of the single-prong hook while resting thereon, and said body having a fastening means for releasably fastening the body to a single-prong hook carried by and projecting forwardly from a carrying structure, said fastening means being capable of maintaining said body assembled with a single-prong hook while being supported thereby in a manner enabling the body to be received in slots formed in packages which are to be displayed, said body being formed at its lower surface which is adapted to engage the hook with an elongated groove which receives the hook, said body carrying adjacent its front end region distant from said fastening means a bridge member extending across said groove and defining therewith an opening through which a front portion of a single-prong hook is adapted to extend.

6. For use with a single-prong support hook having a front end, an elongated substantially rigid body adapted to rest at a lower surface thereof on a single-prong support hook which is adapted to be connected at its rear end to and project forwardly from a carrying structure, with said body having a length sufficiently great to extend along the hook forwardly from the carrying structure at least slightly beyond the front end of the hook, said body being of substantially rectangular transverse cross section and projecting laterally through a substantial distance on opposite sides of the single-prong hook while resting thereon, and said body having a fastening means for releasably fastening the body to a single-prong hook carried by and projecting forwardly from a carrying structure, said fastening means being capable of maintaining said body assembled with a single-prong hook while being supported thereby in a manner enabling the body to be received in slots formed in packages which are to be displayed, said body having at a rear portion thereof a downwardly extending part adaped to engage the front surface of a carrying structure, the single-prong hook having in front of said downwardly extending part of said body a transverse portion and said downwardly extending part being formed with a groove receiving said transverse portion and forming said fastening means.

7. A structure as recited in claim 6 and wherein said downwardly extending part of said body is in the form of a pair of legs each formed with a groove for receiving a transverse part of the hook.

8. The structure of claim 6 and wherein said transverse portion of said hook is situated below the part of the hook which is adapted to carry the body, and the part which extends downwardly at the rear portion of the body being in the form of a pair of legs formed with transverse grooves which receive the lower transverse part of the hook.

9. For use with a single-prong support hook having a front end, an elongated substantially rigid body adapted to rest at a lower surface thereof on a single-prong support hook which is adapted to be connected at its rear end to and project forwardly from a carrying structure, with said body having a length sufficiently great to extend along the hook forwardly from the carrying structure at least slightly beyond the front end of the hook, said body being of substantially rectangular transverse cross section and projecting laterally through a substantial distance on opposite sides of the single-prong hook while resting thereon, and said body having a fastening means for releasably fastening the body to a single-prong hook carried by and projecting forwardly from a carrying structure, said fastening means being capable of maintaining said body assembled with a single-prong hook while being supported thereby in a manner enabling the body to be received in slots formed in packages which are to be displayed, the single-prong hook being of the type which has in front of the carrying structure a transversely extending loop, and said body being formed at its lower surface with an elongated groove for receiving the hook and with a lateral pocket for receiving the transverse loop.

10. The structure of claim 9 and wherein said body has at its rear portion a downwardly extending part formed with a forwardly directed groove for receiving a part of the transverse loop of the hook and forming said fastening means.

* * * * *